United States Patent [19]

Betts et al.

[11] Patent Number: 4,549,486

[45] Date of Patent: Oct. 29, 1985

[54] SMOKE CANISTER

[75] Inventors: Robert E. Betts; John F. Crawford; Robert E. McNeill, all of Huntsville, Ala.

[73] Assignee: The United States of America as represented by the Secretary of the Army, Washington, D.C.

[21] Appl. No.: 614,075

[22] Filed: May 25, 1984

[51] Int. Cl.[4] ..... F42B 13/44

[52] U.S. Cl. ..... 102/334; 102/331; 102/370; 102/283

[58] Field of Search ..... 102/331, 334, 283, 370

[56] References Cited

U.S. PATENT DOCUMENTS

| | | | |
|---|---|---|---|
| 3,120,183 | 2/1964 | Wheelwright et al. | 102/334 |
| 3,718,113 | 2/1973 | Schertler et al. | 102/334 X |
| 3,862,865 | 1/1975 | McManus et al. | 102/358 X |
| 3,960,087 | 6/1976 | Beatty et al. | 102/334 |
| 4,454,816 | 6/1984 | Billard et al. | 102/334 X |

*Primary Examiner*—Peter A. Nelson

*Attorney, Agent, or Firm*—Anthony T. Lane; Robert P. Gibson; Harold W. Hilton

[57] ABSTRACT

A smoke canister used as a spotting charge for locating a point in space where a warhead has been detonated. The canister is provided with a plurality of seals to prevent leakage of the smoke producing chemical in the canister during a very long storage life of the canister in the missile warhead.

2 Claims, 1 Drawing Figure

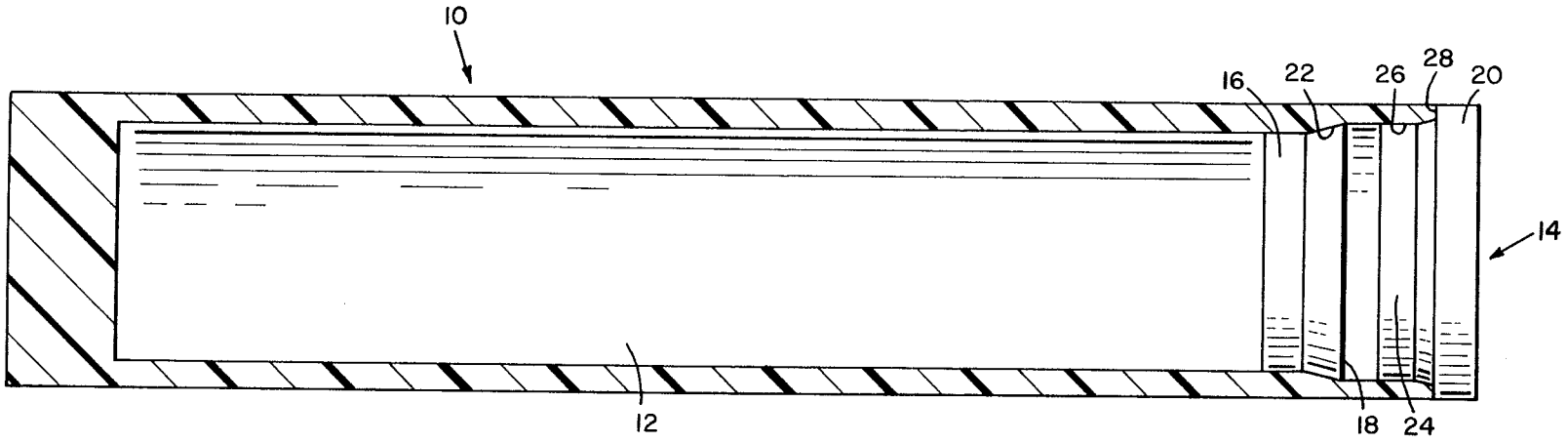
10
12
14
16
18
20
22
24
26
28

SMOKE CANISTER

DEDICATORY CLAUSE

The invention described herein may be manufactured, used, and licensed by or for the Government for governmental purposes without the payment to us of any royalties thereon.

BACKGROUND OF THE INVENTION

This invention relates to a smoke canister used as a spotting charge for detecting warhead events at altitude in large rockets. An example of such a warhead event is the detonation of a rocket at a predetermined distance over a target area whereby in response to the detonation many bomblets are released to descend on the target area for destruction of tanks or other targets in the target area. The smoke canister is released at the same time by detonation of the rocket to produce smoke which marks the point in space where detonation of the rocket occurred. This information is needed so subsequent rounds may be accurately deployed.

In one such rocket system, a plurality of rockets are enclosed in clustered launch tubes. The launch tubes are sealed and the shelf time of the rocket and launch tubes are 10 years. That is, the seal is not broken until rocket firing or 10 years after the rockets are sealed in the launch tubes.

Therefore, the smoke canister of the present invention which is sealed in each rocket must have a life expectancy of 10 years. Therefore, the means for sealing the canister must insure that the smoke producing agent in the canister must be leakproof for 10 years.

It is therefore an object of the present invention to provide a smoke canister to be used as a spotting charge for detecting warhead events at altitude in large rockets.

It is a further object of the present invention to provide such a smoke canister with a seal which will prevent leakage of the smoke producing chemical over a relatively large period of time.

SUMMARY OF THE INVENTION

A smoke canister used as a spotting agent for detecting warhead events at altitude in large rockets. The canister is a methyl methacrylate open cylinder in which titanium tetrachloride is placed. The open end is sealed with three separate methyl methacrylate seals. The first seal is a tapered plug which interfaces with and is glued to the tube or an angled surface. A second seal of castable methyl methacrylate is disposed on top of the first seal and allowed to cure. A third seal is a plug which is glued to fitting angular surfaces of the cylinder.

BRIEF DESCRIPTION OF THE DRAWING

The FIGURE is an elevational partially sectional view of the smoke canister of the present invention.

DESCRIPTION OF THE PREFERRED EMBODIMENT

The canister 10 of the present invention is a methyl methacrylate open cylinder in which titanium tetrachloride 12, is placed then the opened end 14 is sealed with three separate methyl methacrylate seals 16, 18, and 20. The use of titanium tetrachloride as a smoking compound contained in methyl methacrylate has been used for some years. The use of this has been restricted to a short term basis because on long term storage, titanium tetrachloride will attack certain types of methyl methacrylate. In this design the methyl methacrylate chosen is specifically that which uses a non functional plastisizer (plexiglass). Therefore, the titanium tetrachloride will have a minimum reaction with it. A requirement for long term storage also is that the seals must be of high integreties so that the material will not leak through. In the device of the present invention three separate seals are used in series to insure that leakage will not occur over a ten year period of time. The FIGURE shows the design of the smoke canister. The first seal is a tapered plug 16 which interfaces with the tube 10 on an angled surface 22. Glue is applied to these surfaces so that when the plug is put into place it forms a complete seal due to the interaction of the angle of the plug with the tube 10. This plug is glued with a quick setting cement composed of methyl methacrylate containing non functional plasticizers dissolved in methylene chloride. The quick setting of the plug then allows the seal to occur. After this seal has had sufficient time to cure, a second seal 18 of castable methyl methacrylate is put on top of the first seal and allowed to cure. Then the third seal 20 which is a plug which has fitting angular surfaces 24 to the angular surfaces 26 of the cylinder 10 is glued to the cylinder. This seal is provided with a shoulder 28 which abuts against the edge of opening of the tube 10. The loaded tube is designed to take high compressive loads imparted by adjacent mass under rocket acceleration, yet it will rupture at warhead event.

We claim:

1. A smoke canister comprising:

a. a methyl methacrylate tubular member having an open end and a closed end, said tubular member having a smoke producing chemical therein and a pair of bevelled surfaces on the inner surface thereof adjacent said open end;

b. first and second plug members having bevelled surfaces thereon for mating engagement with said bevelled surfaces of said tubular member, said first plug member disposed in said tubular member below said second plug member, said second plug member provided with a shoulder adjacent said tapered surface for engagement with the outer edge of said tubular member;

c. cement means disposed around said plug members for securing said plug members in said tubular member in serial relation, said cement means comprised of methyl methacrylate containing non-functional plasticisers dissolved in methyl chlorine; and, d. seal means of castable material disposed atop said first plug member, said seal means is castable methyl methacrylate placed atop said first plug member and allowed to cure.

2. A canister as in claim 1 wherein said smoke producing chemical is titanium tetrachloride.

* * * * *